US006109174A

United States Patent [19]

Giard

[11] Patent Number: 6,109,174

[45] Date of Patent: Aug. 29, 2000

[54] DOCTOR BLADE FOR A SCREEN PRINTING MACHINE

[75] Inventor: Dominique Giard, Paris, France

[73] Assignee: Fimor Societe Anonyme, France

[21] Appl. No.: 09/155,619

[22] PCT Filed: Apr. 1, 1997

[86] PCT No.: PCT/EP97/01628

§ 371 Date: Apr. 15, 1999

§ 102(e) Date: Apr. 15, 1999

[87] PCT Pub. No.: WO97/36747

PCT Pub. Date: Oct. 9, 1997

[30] Foreign Application Priority Data

Mar. 29, 1996 [FR] France ..... 96 04012

[51] Int. Cl.[7] ..... B05C 17/04

[52] U.S. Cl. ..... 101/123; 101/167; 101/169; 101/155; 101/157; 101/114; 15/256.5

[58] Field of Search ..... 101/123, 114, 101/154, 169, 350.6, 363, 155, 157, 167; 15/256.5, 256.51, 256.52, 256.53

[56] References Cited

U.S. PATENT DOCUMENTS

| | | | |
|---|---|---|---|
| 3,930,445 | 1/1976 | Jaffa | 101/123 |
| 4,373,445 | 2/1983 | Kobler | 101/169 X |
| 4,549,933 | 10/1985 | Judd et al. | 15/256.51 |
| 4,638,733 | 1/1987 | Schneider | 101/123 X |
| 4,978,999 | 12/1990 | Frankel et al. | 15/256.51 |
| 5,001,979 | 3/1991 | Kurten | 101/120 |
| 5,027,703 | 7/1991 | Hancy | 101/123 |
| 5,065,675 | 11/1991 | Tapper | 101/169 X |
| 5,078,061 | 1/1992 | Messerschmitt | 101/123 |
| 5,345,862 | 9/1994 | Giard | 101/123 |
| 5,536,312 | 7/1996 | Madrzak et al. | 101/169 X |

FOREIGN PATENT DOCUMENTS

| | | | |
|---|---|---|---|
| 0167906 | 1/1986 | European Pat. Off. | B41F 15/44 |
| 1315722 | 12/1970 | France | B41F 15/44 |
| 1958912 | 10/1970 | Germany | B41F 15/44 |

*Primary Examiner*—John S. Hilten
*Assistant Examiner*—Minh H. Chau
*Attorney, Agent, or Firm*—Hayes, Soloway, Hennessey, Grossman & Hage PC

[57] ABSTRACT

A doctor blade for use in screen printing includes a head, a base in the form of a lip and at least one elastically deformable member connecting the head and the base. The elastically deformable member is structurally discontinuous on at least one location in the longitudinal direction of the doctor blade extending along a plurality of spaced spring layers. The elastically deformable member is realized from a plurality of elastically deformable wires which are arranged in spirals or in undulations or from a cut-out sheet so as to form a double comb the stiffness of which is controlled by the transverse dimension of the windings, undulations, or cut-outs, or the characteristics of the constituent material, and the spacing between the teeth of the comb.

12 Claims, 9 Drawing Sheets

Fig. 5A
Fig. 5B
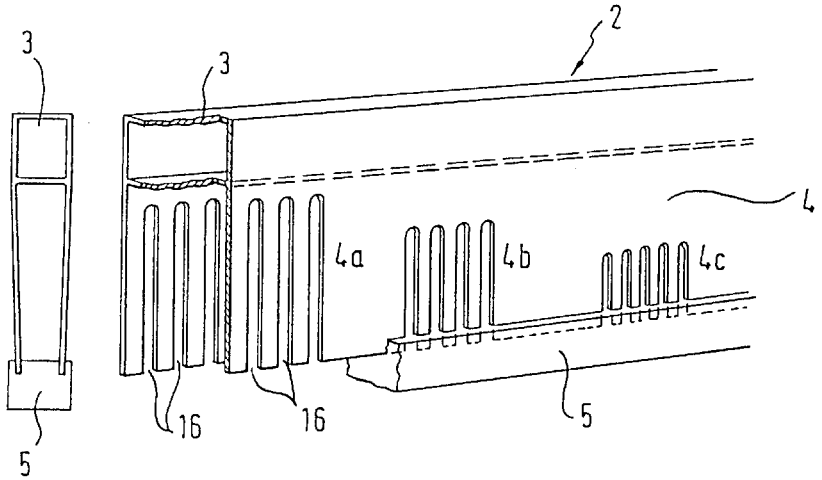
Fig. 6A
Fig. 6B
Fig. 6A'
Fig. 6C
Fig. 6D
Fig. 6E
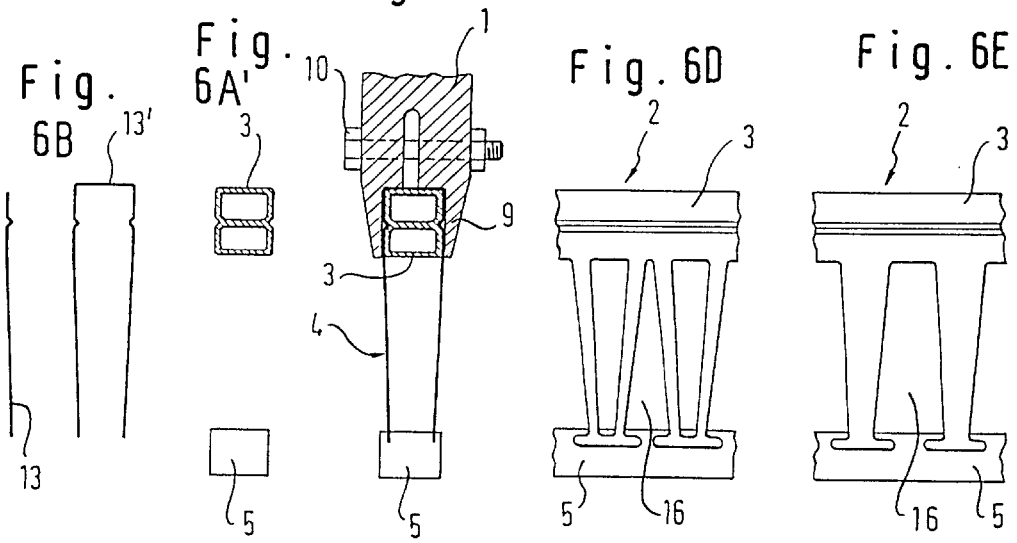

1
2
3
4
4a
4b
5
16
19
23
24

DOCTOR BLADE FOR A SCREEN PRINTING MACHINE

BACKGROUND OF THE INVENTION

1. Field of the Invention

The invention relates to a doctor blade for use in a screen printing machine or for handling by an operator with a view to printing or transferring fluids or pastes, or other applications.

2. Description of the Prior Art

Doctoring heads of the type comprising a doctor blade carrier and a deformable doctor blade extending in the longitudinal direction and being rigidly associated to each other are known. Such known doctoring heads constitute the subject-matter of many various embodiments. They are fixed to carrier means of the machine by means of screws, bows or other clamping or fixing means.

The pressure to be exerted downwardly must simultaneously:

- eliminate what is called in the art "off contact", i.e. the spacing of 2 to 5 millimeters existing between the screen and the printing carrier, this function essentially lying with the ends of the doctor blade;
- compensate for thickness differences of the stencil, the carrier of the image applied on or under the screen;
- compensate for irregularities of the printing carriers whose thickness may vary more or less than 6% for cardboard, for instance, depending on the seams and hems for textile printing, etc.;
- drive an appropriate and constant ink portion through the screen for carrying out the printing process, releasing energy in dependence upon the ink thixotropy;
- push the ink wave accumulating before the doctor blade according to its feeding rate.

Before each doctoring action, a metallic counterdoctor or, according to the terminology in the art, a "flood bar" slightly touches the screen in order to respread the ink which had been pushed towards an edge of the screen by the preceding printing process.

The doctor blade traditionally consists of rubber and typically has the shape of a rectangular parallelepiped, continuous both in the longitudinal and transverse directions. It may also comprise, in the portion in contact with the screen, different profiles, which may be considered more favourable for certain work.

The doctor blade must simultaneously comprise features which seem to be contradictory.

It must be sufficiently rigid (tough) in order to:

- eliminate the "off contact";
- drive an adequate and constant part of the ink throught the screen to carry out the printing operation;
- push the ink wave accumulating before the doctor blade according to its feeding rate.

Moreover, the doctor blade must be sufficiently resilient in order to:

- compensate for irregularities of the carrier of the image applied on or under the screen;
- compensate for irregularities of the printing carriers;
- compensate for the surface irregularities of the printing tables.

According to other prior art embodiments, the doctor blades are incorporated in machines. More particularly, reference may be made to U.S. Pat. No. 4,854,230, EP-A-140 165, EP-A-460 267. Irrespective of whether the doctor blade is intended for manual function, as taught in GB-A-2 175 850, U.S. Pat. No. 4,102,266, FR-A-2 302 199, U.S. Pat. No. 4,989,511, or whether it is incorporated in a machine, there arises a problem to have a doctor blade comprising both the rigidity and the flexibility required, which had been explained above.

Document U.S. Pat. No. 5,345,862 provides in one embodiment a doctor blade comprising two external layers and a more rigid internal layer.

Reference may also be made to EP-A-0298911 and DE-B-38 12 826.

EP-A-167 906 provides a carrier bar of a hard-elastic material inserted in the doctor blade carrier, to which a profiled blade of a resilient material is connected.

Irrespective of the realization variants envisioned for the doctor blade, there arise a certain number of problems for which no satisfying solution has hitherto been found yet.

The doctoring carrier inevitably comprises surface irregularities. During doctoring, the movement of the doctor blade causes vibrations due to these surface irregularities, which both impair the printing quality and contribute to the wear of the machine comprising the doctor blade.

In addition to the vibrations, the surface irregularities influence the printing process since the operating conditions, more particularly the contact pressure of the doctor blade, its inclination angle and even its contact with the printing carrier are variable from one location to the other of the printing surface.

If the doctoring speed is high, the accumulated ink before the doctor blade may result in a phenomenon of "encreplanage; ink-planing" (neologism in analogy with aquaplaning and meaning that the doctor blade is lifted off by an ink film) which again impairs printing quality.

Known doctor blades cannot be conveniently regulated with respect to their stiffness, both in time and locally in any zone of their length.

It is certainly known to provide a doctor blade at its end portions with lowering means, screens as described in U.S. Pat. No. 5,345,862, in particular. Also it has been suggested to provide doctor blades with a curved profile. However, all these implementations are complicated, often not very precise, of limited applicational scope and, finally, of unsatisfactory efficacy with respect to the current requirements relating to quality and productivity.

Thus, it is the object of the invention to overcome the drawbacks or limitations of the current doctoring heads.

More particularly, the invention aims to resolve the problems relating to surface irregularities of the doctoring carriers.

SUMMARY OF THE INVENTION

For the purpose, the invention relates to a doctor blade for use in a screen printing machine or for handling by an operator with a view to printing or transferring fluids or pastes, or other applications, including a head, a base in the form of a lip and at least an elastically deformable member connecting the head and the base, the flexibility of the doctor blade at any point along its length, resulting from a combination of the inherent flexiblity of the lip and the elasticity of the elastically deformable member, characterised in that the elastically deformable member is structurally discontinous on at least one location in the longitudinal direction of the doctor blade and extends along a plurality of spaced spring layers.

The elastically deformable member is located on the whole, substantially the whole or just part of the length of the doctor blade. The doctor blade comprises just one or a plurality of elastically deformable members.

The respective elasticities of the lip and the elastically deformable member preferably differ from each other.

In one embodiment, the body of the elastically deformable member is realised from one or a plurality of elastically deformable wires, more particularly metallic wires, being arranged in spirals or in undulations or from a cut-out sheet in order to form a single or double comb the stiffness of which may be regulated by the transverse dimension of the windings, undulations, cut-outs or by the characteristics of the constituent material or by the spacing between the teeth of the comb.

The teeth of the comb constituted by the elastically deformable member exert individually a pressure onto each of the longitudinal sectors of the lip, which thus are made independent.

In one embodiment, the independent distribution of the pressure via the teeth of the comb of the member is completed by a sliding action of the head in a doctor blade carrier and the effect of an inflatable sleeve.

The elastically deformable member comprises a plurality of functional parts as regards elasticity, said functional parts being disposed along the longitudinal direction of the doctor blade and being essentially independent of each other so that they are able to take the surface irregularies of the printing carrier into account.

If need be, there is provided a certain flexible interdependence between the windings or undulations concerned towards the doctoring lip, namely due to a certain overlapping of the windings or undulations and/or a connecting member for the windings or undulations such as a wire or cable extending in parallel with the length of the doctor blade.

According to another embodiment, the body of the elastically deformable member comprises at least one and, more particularly, two wires arranged in spirals or undulations for defining with the head and the base a quadrilateral being deformable according to the pressure exerted by the doctor blade on the printing carrier.

This deformable quadrilateral is either a parallelogram which is deformable in such manner that the inclination angle of the lip on the printing carrier is constant irrespective of the pressure of the doctor blade on the printing carrier, or a trapezium whose major base is situated towards the head and, inversely, whose minor base is situated towards the base of the elastically deformable member, the inclination angle then being modified as intended with the pressure of the doctor blade on the printing carrier.

According to one embodiment, the body of the elastically deformable member, the head and the base are electrically conductive or associated to be flush in such manner that a certain electric continuity be ensured between the lip and the doctor blade carrier via the elastically deformable member in order to discharge static electricity.

The elastically deformable member may be realised from plastics or metal, a metal alloy or in combination of plastics, metal, metall alloy. This material may be reinforced or not.

The doctoring lip itself presents itself in the form of a ribbon of one or a plurality of layers possibly being profiled. Its constituent material is selected from the group consisting of elastomers, rubbers, plastics or other equivalent materials and polyurethanes, in particular.

This lip with a height of about 10 to 30 mm, which is elastically secured to the elastically deformable material, is realised via casting, extruding, machining or an equivalent process. If need be, it is electrically conductive in order to discharge the static electricity developed during the doctoring process.

According to one embodiment, the doctoring lip comprises two portions, namely a core being permanently fixed to the base of the elastically deformable member and an outer doctoring portion, preferably having a low linear mass and being fixed to the core. This fixing is releasable, via clipping-on or in any other manner.

A doctor blade like the one just having been described may further comprise two screen lowering means at its two ends.

The elastically deformable member may be tight or closed, but preferably comprises, at least on one portion of the doctor blade length, a plurality of openings or bores above the lip, allowing the passage of excess printing ink.

The doctoring lip of the described doctor blade may have a reduced transverse height, more particularly in the order of centimeters. This small height allows for the passage of the excess printing ink above so that the doctor blade may be used in two directions. For certain applications, this height may even be reduced to a simple steel wire, the elastomer portion having been left out.

In one embodiment, the elastically deformable member presents itself in the general form of a ribbon having an essentially constant width or of a sheet or a band comprising one or a plurality of cut-outs or excrescences extending transversely, or of a comb or a spiraled or undulated piece comprising protrusions to extend vertically, in particular.

These excrescences or projections extend either over the same distance along the doctor blade or over distances differing in dependence upon the desired flexibility/hardness.

Since adjacent functional portions, which are essentially independent of each other, form part of the elastically deformable member, the excrescences or protrusions in particular are juxtaposed or essentially juxtaposed, or are spaced in the longitudinal direction of the doctor blade. If need be, this spacing is variable in dependence upon the desired flexiblity/hardness.

A layer, along which an elastically deformable member extends, is typically situated between or outside, but in the vicinity of the two planes externally defining the doctoring blade.

In one embodiment, an elastically deformable member is interposed between the head and the lip. More particularly, the elastically deformable member constitutes the only or main member via which the lip is carried by the head.

The head is generally relatively hard, about 60° Shore and higher, and is intended to be fixed in the manual doctor carrier or the machine, namely at a height of about 10 to 30 mm, preferably 12 to 18 mm. The upper portions of the elastically deformable members are rigidly fixed in the head or on the surface thereof.

According to one embodiment, the doctor blade head freely slides in the doctor blade carrier, an inflatable sleeve ensuring equal pressure at any point of the lip, irrespective of the irregularities of the printing carrier.

The elastically deformable member and the doctoring lip are essentially disposed in the extension of each other.

In one implementation, the elastically deformable member presents itself, in part at least, in the form of a portion of the doctor blade head having a certain capacity of elastic deformation.

The elastically deformable member has a different linear mass than the one of the actual doctoring blade so as to have a vibration period which largely differs from the one of the lip, the combination of the lip and the elastically deformable member(s) not being likely to resonate under normal operating conditions, during doctoring of a carrier comprising surface irregularities.

The elastically deformable member is rigidly fixed to the head on the one hand and elastically to the lip on the other hand, namely by flanging, bonding, moulding or equivalent processes. This association is realised either with immobilization or with a certain possibility to pivot relatively about an axis extending in parallel with the doctor blade length.

In a specific embodiment, the elastically deformable member is functionally and/or structurally composite and comprises a rigid or essentially rigid head intended to be associated with the doctor blade carrier, a semirigid base destined to be associated with a releasable lip and, between the head and the base, a body essentially constituting the elastically deformable member. The head and/or the base and/or the body are associated in a releasable fashion or not.

According to one embodiment, the body of the elastically deformable member is associated with the head and/or the lip in a releasable fashion via or by means of fixing members like clips.

The head and the base comprise a profiled shape. The doctoring lip is associated with the head and/or base of the elastically deformable member or forms an angle therewith with respect to the longitudinal axis of the doctor blade.

The head preferably comprises a profile such that installation is possible on a doctor blade carrier having a plurality of inclination angles with respect to the longitudinal axis of the doctor blade.

The doctor blade, which has just been described, comprises numerous advantages:

The flexibility/hardness of the doctor blade may be adapted in all directions, more particularly from the top downwards. Also doctor blades may be produced whose stiffness is slightly higher in the center and strong at the ends thereof.

The doctor blade avoids "inkplaning" at high speeds, since the edge of the lip no longer touches the screen and excess ink may possibly be evacuated above the upper edge of the lip if it is fluid enough.

Under certain conditions, it may no longer absolutely be necessary to resort to a counterdoctor, the printing process may be quicker, in forward and backward operation, in particular.

Such a doctor blade enables optimisation of the ink flow and control of the hydraulic pressure and the quantity of ink applied, irrespective of the doctoring speed.

The doctor blade makes it possible to master the doctor blade's angle of attack, irrespective of the vertical contact pressure exerted on the doctoring lip. According to the needs, with two essentially parallel spring layers, this angle remains constant or is, on the contrary, modified positively in dependence upon the exerted pressure.

A doctor blade according to the invention makes it possible to take advantage of the fact that the constituent material of the elastically deformable member does not keep any permanent deformation, in contrast to the rubbers of conventional doctor blades.

This makes it possible to generate flap-like to-and-fro or a "flip-flap" effect for certain printing machines. This effect enables the doctor blade to come back to first position at every end of sliding stroke, no expensive systems for quick inclination nor a double doctor blade nor a flood bar being required.

The doctor blade according to the invention enables the lip to be adapted precisely to the printing carrier even if the latter comprises surface irregularities. Spacing variations may be corrected.

A doctor blade according to the invention also makes it possible to transfer the pressure on the screen out of the printing zone, which results in a longer life of the constituent elements of the machine as well as of the screen serving for printing.

Resonance effects resulting from surface imperfections of the printing carrier are eliminated or dampened. The same is true for vibrations entailed by these surface imperfections.

A doctor blade like the one described above also enables a reduction of the overall weight over a conventional doctor blade. This weight reduction results in lower inertia, which is favourable for the doctor blade operation.

BRIEF DESCRIPTION OF THE DRAWINGS

Further characteristics of the invention may be taken from the following specification upon reference to the enclosed drawings; therein:

FIG. 1 is a sectional view of a known doctor blade, while

FIGS. 2A, 2B, 3A, 3B, 3C, 3D, 3E, 3F, 3G, 3H, 4A, 4B, 4C, 4D, 5A, 5B, 6A, 6A', 6B, 6C, 6D, 6E, 7A, 7B, 7C, 7D, 8A, 8B, 8C, 9A, 9B, 10A, 10B, 11A, 11B, 12, 13A, 13B, 13C are views of different embodiments of the invention.

DETAILED DESCRIPTION OF PREFERRED EMBODIMENT

Figure 1:
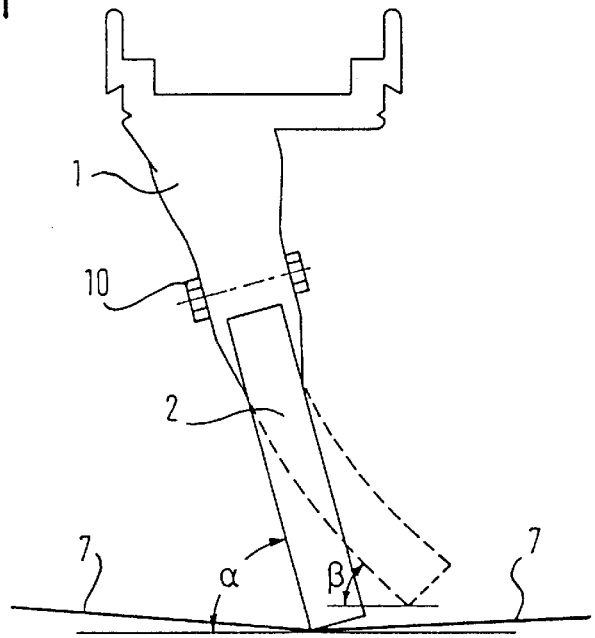

FIG. 1, a doctor blade 2 is fixed to doctor blade carrier 1 by a screw 10. One may see that angle $\alpha$ on the screen 7, which had initially been set to about 75°, rapidly decreases, during flexure, to an angle $\beta$ of 40°. This happens regardless of whether doctor blade 2 comprises one or a plurality of layers.

Figure 2A:
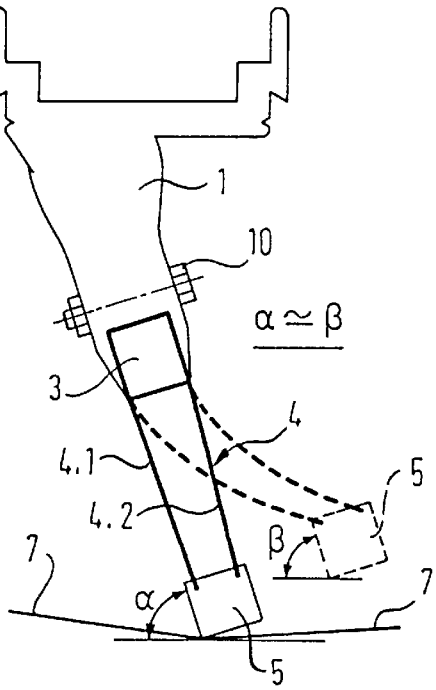

In FIG. 2A, which represents a doctor blade 2 according to the invention seen in profile, one may see that angle $\beta$ formed by lip 5 at work equals the initial angle a due to the effect of the deformable parallelogram 4.1 and 4.2.

Figure 2B:
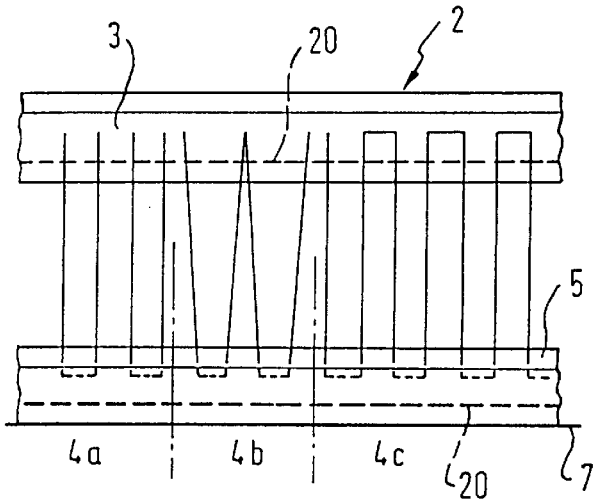

FIG. 2B is a front view of different types of springs 4*a,* 4*b* and 4*c* which may constitute the double member 4 being elastically deformable.

Figures 3A, 3B, 3C, 3D, 3E, 3F, 3G, 3H, 4A, 4B, 4C, 4D:
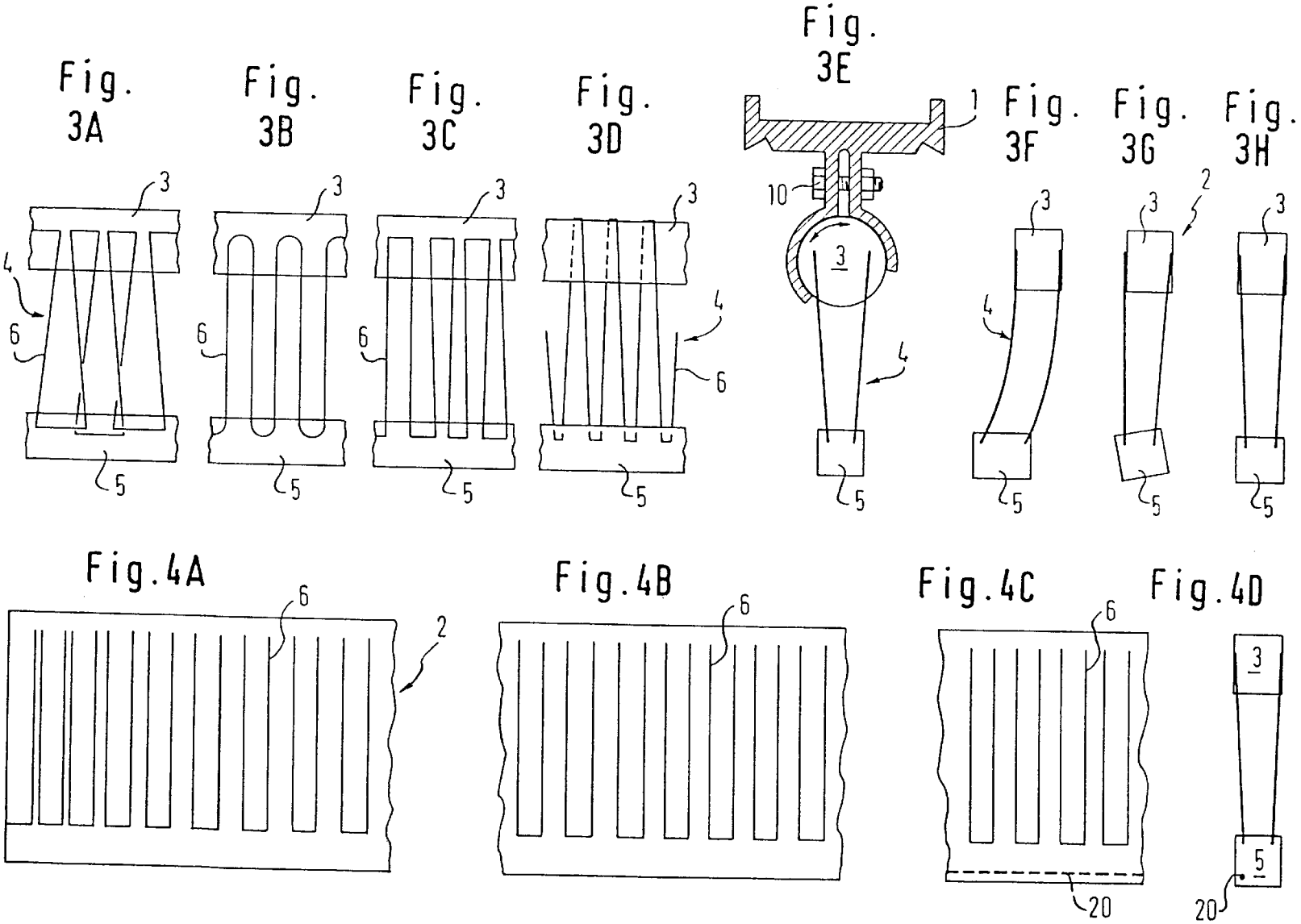

FIGS. 3A, B, C and D illustrate various springs. FIG. 3A represents the overlapping of the windings of spring 4, generating a flexible interdependence in lip 5. FIG. 3C illustrates a way to harden the doctor blade 2 by approaching windings 6 to each other.

FIGS. 3E to H are sectional views of the different arrangements of the elastically deformable member. FIG. 3E illustrates a doctor blade with adjustable angle intended for older machines which do not dispose over this adjustment.

FIGS. 4A, B and C illustrate the punctual variations in the hardness of a doctor blade 2 due to variations in the spacing of the U-shaped pins constituting the elastic member. FIG. 4D represents the same doctor blade seen in profile. Note the trapezoidal shape.

FIG. 5A illustrates the case where the elastically deformable member 4 is the extension of head 3, a plastic profile in the present case. Sectors 4*a,* 4*b* and 4*c* illustrate the hardness adjustment, slots 16 being pierced more or less deeply. FIG. 5B represents the same doctor blade seen in profile.

FIG. 6A represents a doctor blade 2 whose elastically deformable member 4 is constituted either by a band 13' (FIG. 6B) bent to be U-shaped or by two bands 13. (FIG. 6C) A plastic profile constitutes head 3 of doctor blade 2, (FIG. 6A') it is included in the U or clamped between the two bands by doctor blade carrier 1. The front views (FIGS. 6D and 6E) illustrate two types of teeth, hollow or solid, of the elastically deformable member 4.

Figure 7A:
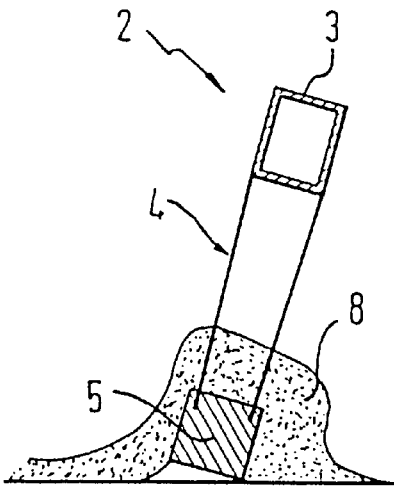
Figure 7B:
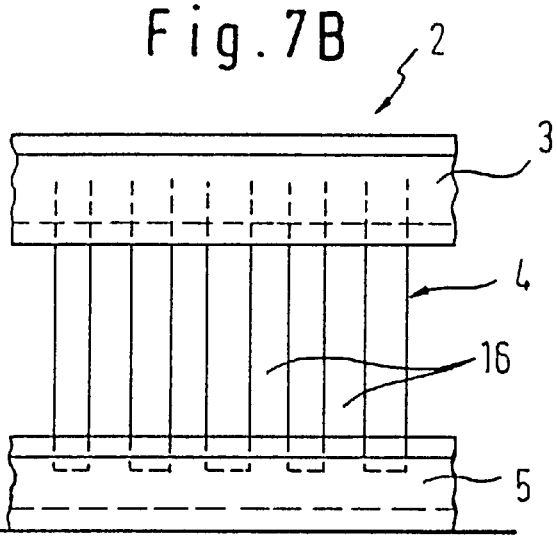

FIGS. 7A and 7B illustrate the passage of ink 8 having low thixotropy in openings 16 between the teeth of the comb constituting the elastically deformable member 4.

Figure 7C:
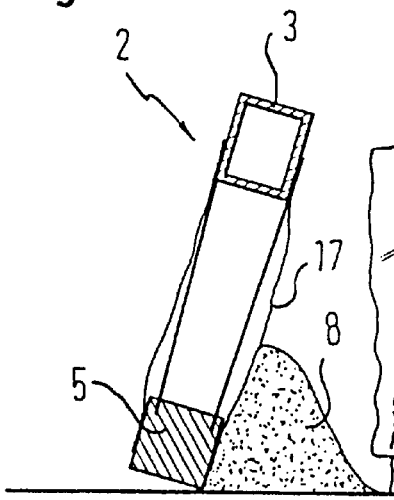
Figure 7D:
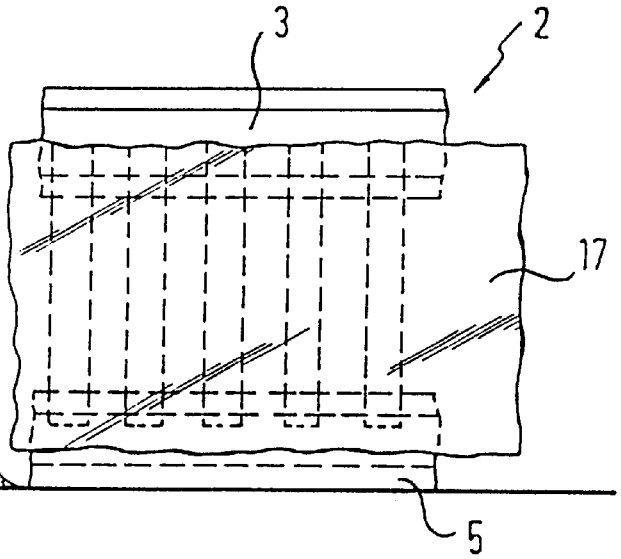

FIGS. 7C and 7D openings 16 are obturated by adhesive 17 for easier cleaning without overloading the apparatus.

Figure 8A:
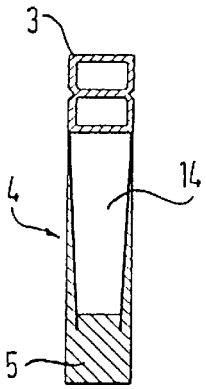
Figure 8B:
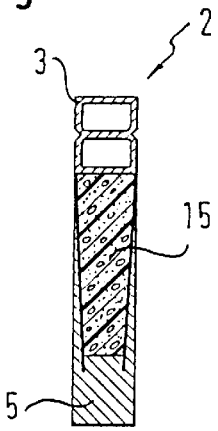
Figure 8C:
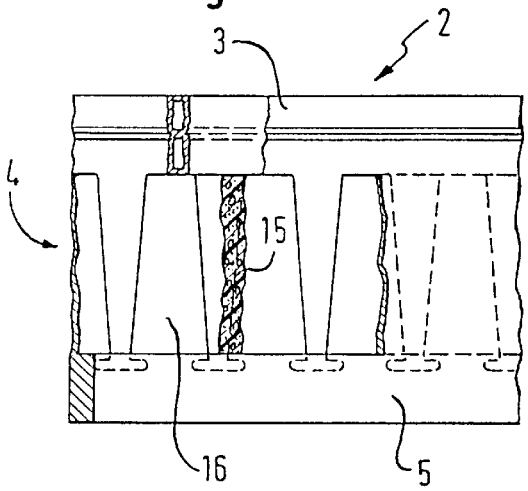

FIG. 8A illustrates a doctor blade wherein the springs are coated with a thin layer of rubber constituting lip 5 over the major part of their height. Space 14 between the two layers of springs is either empty or filled with foam 15. (See FIG. 8B) Front view FIG. 8C illustrates, in elevation, the different constituent layers of the elastically deformable member 4 in the case of a foam filling.

Figure 9A:
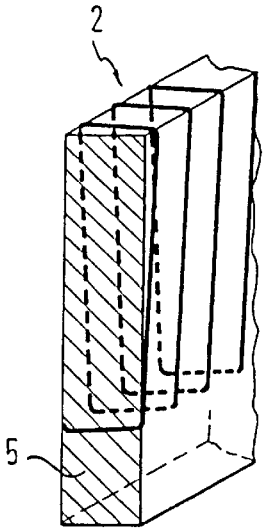
Figure 9B:
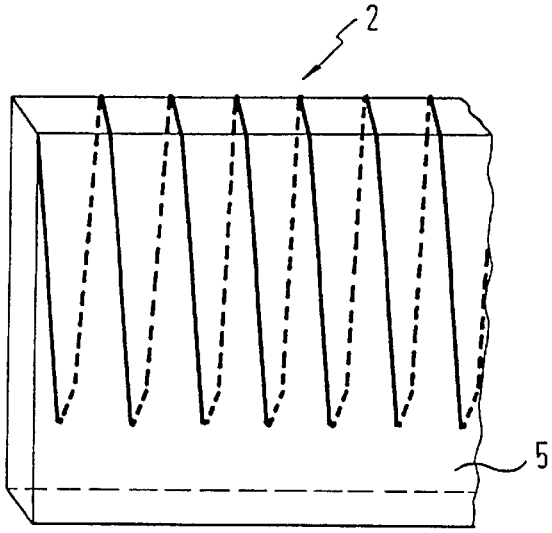

FIGS. 9A and 9B illustrate a design in spirals, rectangular and with a single wire, completely embedded in the material constituting lip 5. This arrangement is adapted to doctor blades having small sections.

Figure 10A:
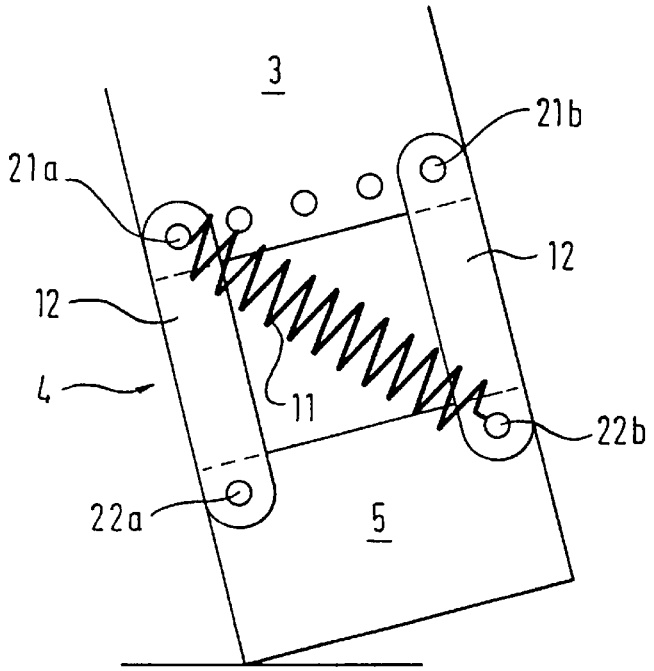
Figure 10B:
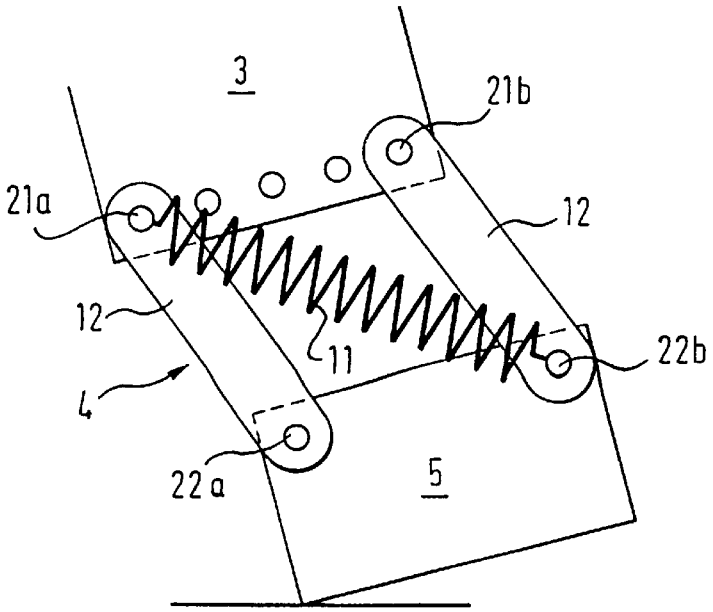
Figure 11A:
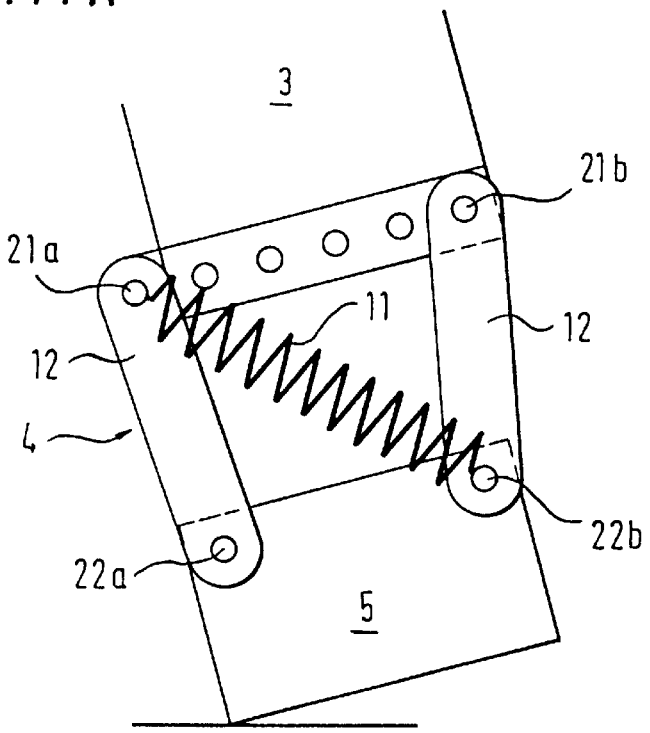
Figure 11B:
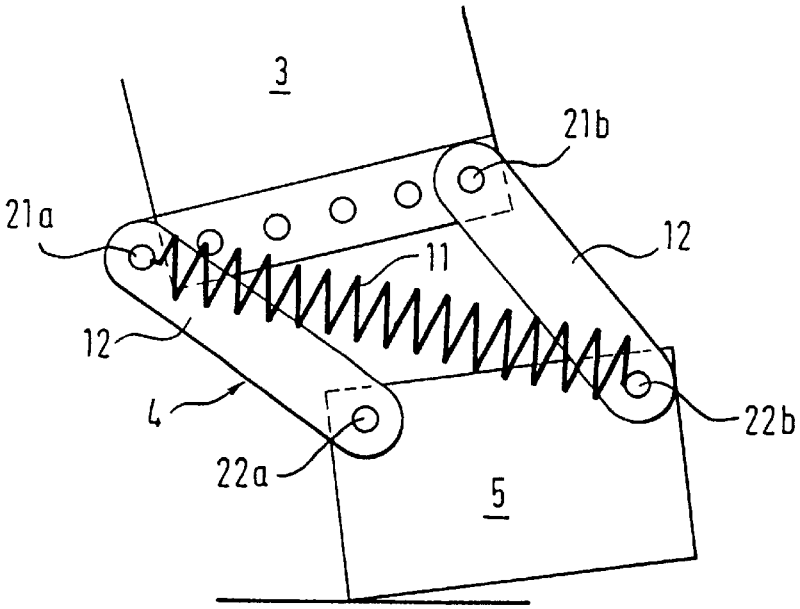

FIGS. 10A, 10B, 11A and 11B are two pairs of schemata illustrating the structure of a doctor blade whose elastically deformable member constitutes a quadrilateral, namely in different possible embodiments, the pressure being higher in the case of FIGS. 10B and 11B than in the case of FIGS. 10A and 11A; in FIG. 11B, the trapezoid shape positively correcting the angle under the vertical pressure.

Figure 12:
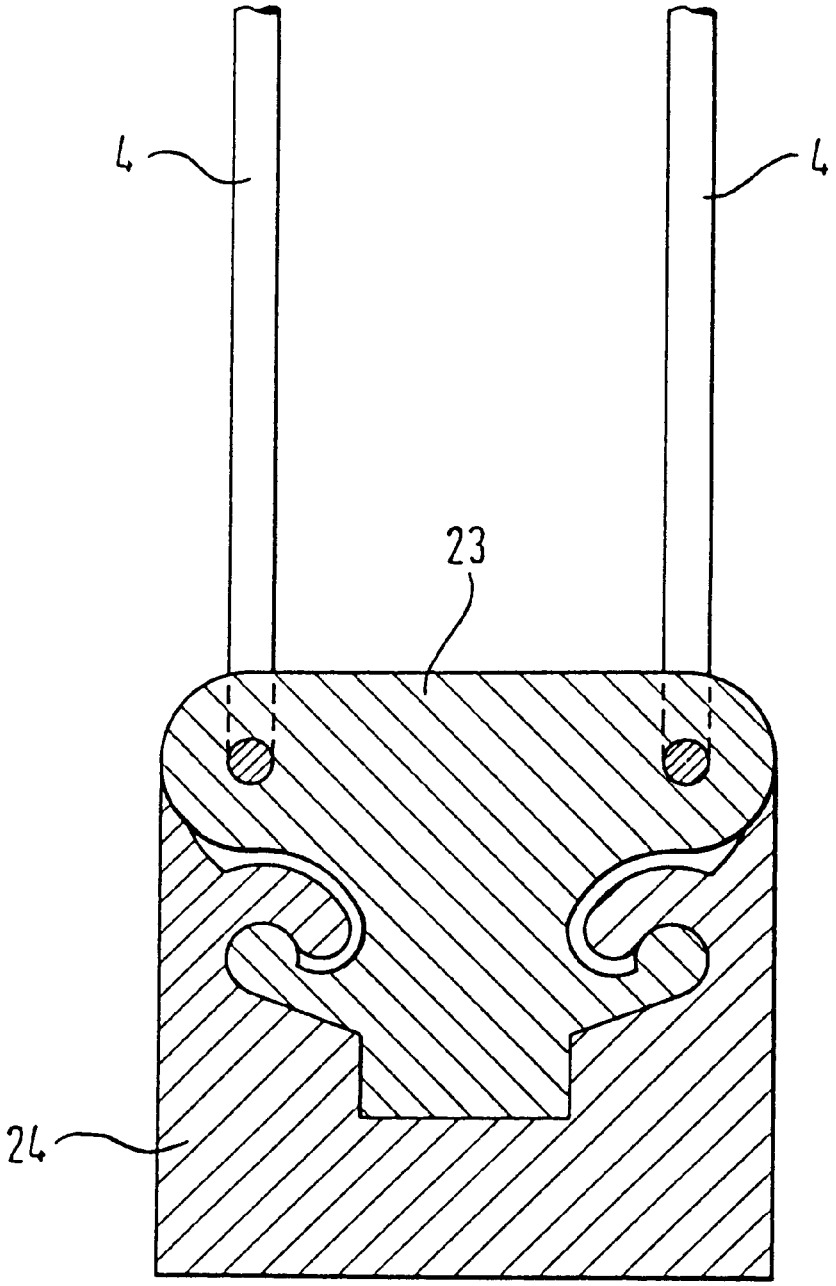

FIG. 12 also illustrates a modified embodiment of the doctor blade wherein the doctoring lip is provided in two portions, one of which being easily releasable via clipping.

Figures 13A, 13B, 13C:
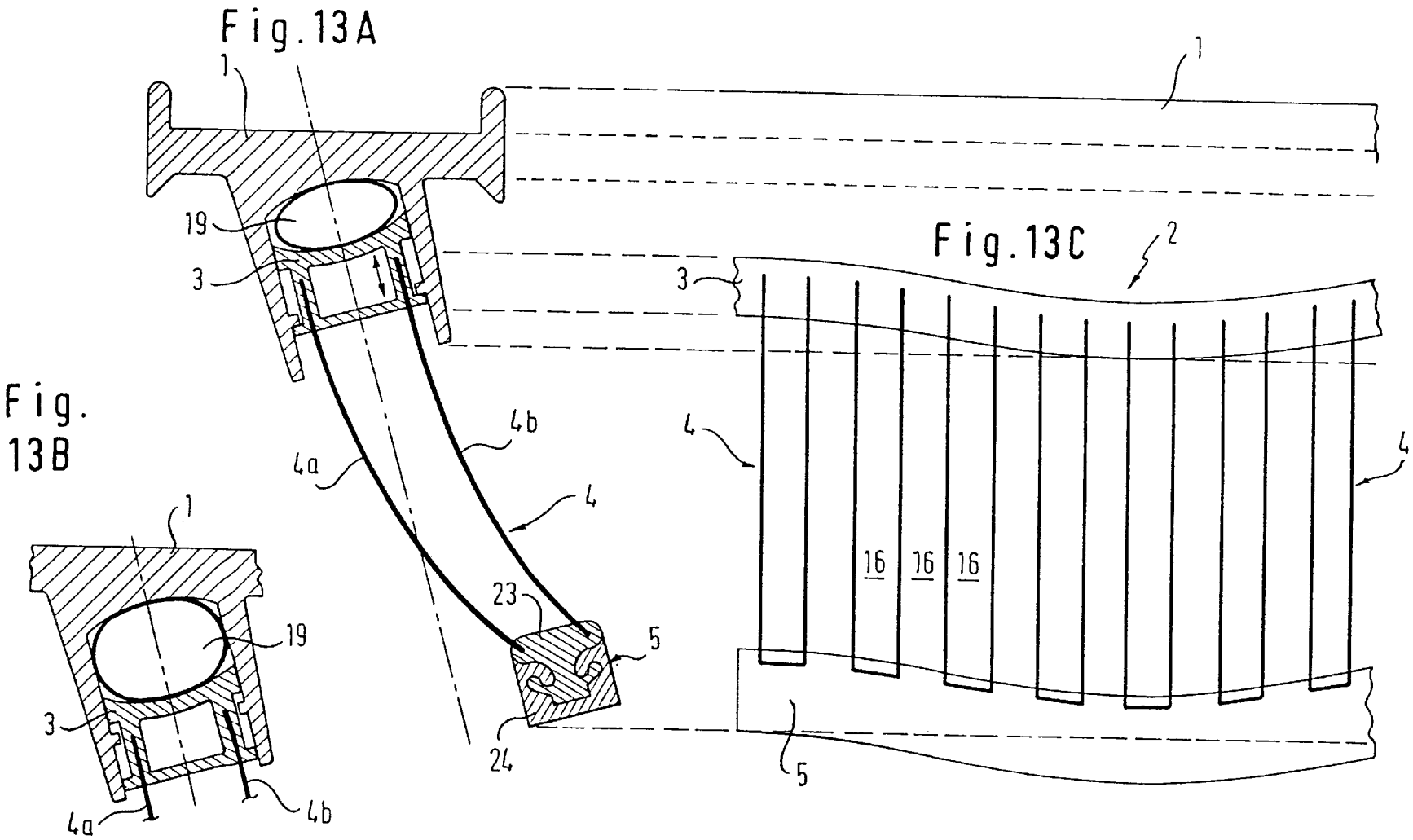

FIGS. 13A, B and C illustrate a doctor blade whose head 3, which takes longitudinal flexures, may slide vertically in doctor blade carrier 1, an inflatable sleeve 19 exerting a constant linear pressure downwardly. The lower portion 5 is constituted by a fixed core 23 and a releasable lip 24.

In the embodiments represented in detail in the figures, the doctor blade 2 is functionally and structurally composite and comprises a head 3, a lip 5 and an elastically deformable member 4.

Head 3 is rigid or essentially rigid, it is intended to be functionally associated with doctor blade carrier 1. Member 4 is placed between head 3 and lip 5. Head 3 and lip 5 comprise a profiled shape. Member 4 itself is profiled as well, solid or pierced.

Due to such a profiled shape, lip 5 may be associated with head 3 or form a certain angle $\alpha$, $\beta$ with respect to the longitudinal plane of doctor blade 2.

According to the embodiments considered, the elastically deformable member 4 presents itself in the general shape of a ribbon having an essentially constant width, the transverse profile thereof being susceptible of more or less machining, either in the form of a ribbon comprising one or a plurality of slots or excrescences extending transversely, or in the form of a comb or in the form of a spiraled or undulated piece equally comprising protrusions. More particularly, these protrusions extend transversely. According to other embodiments, they may extend in any other manner.

These excrescences or projections extend either over the same distance along the doctor blade or, alternatively, over distances differing in dependence upon the desired flexibility/hardness, in particular.

These excrescences/projections more particularly constitute portions which are essentially independent of each other and which have been discussed above.

Such so-called functional portions, more particularly the excrescences or protrusions are juxtaposed or essentially juxtaposed or superposed, or are spaced apart from adjacent functional parts in the longitudinal direction of the doctor blade.

This spacing is either constant or variable in dependence upon the desired flexiblity/hardness, in particular.

In FIGS. 2 and 2B, one may see that the doctor blade 2 is rigidly and releasably associated with doctor blade carrier 1. Doctor blade 2 being in contact with screen 7 comprises a head 3, a base in the form of lip 5 and at least one elastically deformable member 4 connecting head 3 and base 5. The unit extends longitudinally along an axis. During operation, this axis is placed horizontally or essentially horizontally. Doctor blade carrier 1 has a high unit rigidity and constitutes the carrier element of doctor blade 2. In contrast thereto, doctor blade 2 is deformable to a certain extent.

Head 3 as well as lip 5 of doctor blade 2 present themselves in the form of a ribbon of one or a plurality of layers of elastomer polyurethane, each having a height of about 12 to 18 mm, but of differing elasticities, head 3 being more rigid and the lip being more flexible.

The elastically deformable member 4 according to FIGS. 2 to 4 is realised from one or a plurality of elastically deformable wires arranged in undulation so as to form a single or double comb whose stiffness is adjustable via the transverse dimension of undulations 6 or via the characteristics of the constituent material or via the spacing existing between undulations 6. A wire or cable 20 extends in parallel with the length of doctor blade 2 in order to generate a certain flexible interdependence in undulations 6 towards lip 5.

The elastically deformable member 4 is structurally discontinuous in the longitudinal direction of doctor blade 2 on at least one location due to the sequence of the wire forming undulations 6 and the space between undulations 6.

Structurally discontinuous means that the elastically deformable member 4 is realised such that a material or mechanical discontinuity is ensured along doctor blade 2. The structural parts 6 constituting elastically deformable member 4 are then spaced apart from each other.

Doctor blade 2 comprises at least one elastically deformable member 4 situated on at least one location of its length.

The elastically deformable member 4 acts on lip 5 in such a manner that the flexibility of doctor blade 2 at the location where member 4 is situated results from the combination of the inherent flexibility of lip 5 and the elasticity of elastically deformable member 4. The respective elasticities differ from each other.

In accordance with the embodiments, the elastically deformable member 4 is disposed over the whole length of the doctor blade or essentially over the whole length or over a part of said length only. For instance, the elastically deformable member 4 is disposed at the outer portions of the doctor blade or, on the contrary, in its central portion.

If need be, one or a plurality of elastically deformable members 4 may be provided and disposed, in combination, over the whole or essentially the whole length of doctor blade 2 or over a portion thereof only. Doctor blade 2 comprises either just one elastically deformable member or a plurality thereof.

In the embodiment, which is more specifically represented in FIG. 2B, the elastically deformable member 4 comprises a plurality of functional portions with regard to elasticity.

These functional portions are situated along the longitudinal direction of doctor blade 2. These functional portions are essentially independent of each other as regards function. This means that one functional portion of the elastically deformable member 4 may react to biasing, more particularly due to irregularities of the printing surface, essentially without influencing the adjacent functional portion of the elastically deformable member 4.

Moreover, the elastically deformable member 4 comprises passages, openings, perforations, spacings, slots or analogue piercings 16 above lip 5, allowing for the passage of excess printing ink. Thus, doctor blade 2 does not comprise a counterdoctor and is more simple than in the prior art.

The one or several elastically deformable members 4 have a linear mass differing from the one of lip 5. It follows therefrom that the elastically deformable member 4 has a vibration period which clearly differs from the one of lip 5. Thus, the combination of lip 5 and the one or several elastically deformable members 4 is not susceptible of resonating under normal operating conditions of doctor blade 2. More particularly, this resonance is prevented or dampened during the doctoring of a carrier comprising surface irregularities which conventionally appear.

According to the considered embodiments, the elastically deformable member 4 is separate from head 3 and/or lip 5, such as being secured to head 3, or constitutes an integral part of head 3 and/or lip 5.

In the embodiments represented above, the elastically deformable member 4 is associated with head 3 and lip 5 while being interposed between these. More particularly, the elastically deformable member 4 constitutes the only or main member via which lip 5 is carried by head 3.

In these embodiments, the elastically deformable member 4 is situated transversely, over a portion at least, in extension of head 3 and lip 5.

Transverse direction here means a direction generally orthogonal with respect to the longitudinal axis of doctor blade 2.

According to the embodiment of FIGS. 2A and 2B, head 3 of doctor blade 2 is rigidly fixed in the vice constituted by jaws 9 of doctor blade 1 via screw 10. Here, the elastically deformable member 4 is formed of two wires or sheets being structurally discontinuous on at least one location in the longitudinal direction of doctor blade 2 and constituting two combs extending along two layers of springs spaced apart from each other. One may see the elastic deformations via which it is possible to adjust or fix the inclination angle of lip 5 and, accordingly, the attack angle $\alpha$ of doctor blade 2 on screen 7 or on the printing carrier.

Such a layer is generally disposed between or outside, but in the vicinity of the planes externally defining doctor blade 2. For instance, a layer, along which the elastically deformable member 4 extends, is essentially situated either in the central zone between the two planes or in the vicinity of at least one of the planes externally delimiting doctor blade 2.

In FIGS. 3 to 6, the elastically deformable members 4 also extend along a plurality of spring layers spaced apart from each other (seen in profile views FIGS. 3E to H).

In the case of FIG. 3A, the windings or undulations of member 4 have a triangulular shape and overlap each other in lip 5 in order to ensure a flexible interdependence, while lying in the extension of head 3.

According to a preferred aspect, which is demonstrated in FIGS. 10A/B and 11A/B, a double member 4 being elastically deformable comprises pivoting elements 12, for instance in the form of two wires arranged in spirals or undulations, which define a deformable quadrilaterial with head 3 and lip 5. This quadrilateral has four apexes, namely two apexes 21*a*, 21*b* in head 3 and two apexes 22*a*, 22*b* in lip 5. Apexes 21*a* and 22*a* are situated on one side of the double member 4 being elastically deformable and belong to one of the wires whereas apexes 21*b* and 22*b* of the other, opposite side belong to the other wire. At each end of doctor blade 2, a spring 11 diagonally connects pivoting elements 12.

With such a structure, the inclination angle of lip 5 is maintained irrespective of the pressure of the doctor blade on the screen or printing carrier. This situation may clearly be seen from a comparison of FIGS. 10A and 10B. It follows therefrom that lip 5 presents the same angle a irrespective of the pressure of the doctor blade on the screen or the printing carrier.

In the case of FIG. 11A, apexes 21*a*, 21*b*, 22*a*, 22*b* form a trapezium whose grand base is situated on the side of head 3 and whose small base on the side of lip 18. When pressure is exerted on head 3, there is an angular gain of lip 5.

In the variant implementation of FIG. 12, the doctoring lip comprises two parts, namely a core 23 permanently fixed to the base of elastically deformable member 4 and an outer doctoring portion 24 having a low linear mass and being fixed to core 23. This fixation is of the releasable clip-on type in this case.

What is claimed is:

1. A doctor blade for use in screen printing comprising a head, a base in the form of a lip and at least one elastically deformable member connecting the head and the base, the flexibility of the doctor blade at any point along its length resulting from a combination of the inherent flexibility of the lip and the elasticity of the elastically deformable member, wherein said elastically deformable member being structurally discontinuous on at least one location in the longitudinal direction of the doctor blade extending along a plurality of spaced spring layers, and whereas said elastically deformable member is realized from a plurality of elastically deformable wires being arranged in spirals or in undulations or from a cut-out sheet so as to form a double comb the stiffness of which is controlled by means selected from the group consisting of the transverse dimension of the windings, undulations, or cut-outs, the characteristics of the constituent material, and the spacing between the teeth of the comb.

2. The doctor blade of claim 1, wherein said lip comprises a plurality of longitudinal sectors and said comb comprises teeth constituted by the elastically deformable member with said teeth exerting individually a pressure onto each of the longitudinal sectors of said lip, which thus are made independent.

3. The doctor blade of claim 2, wherein an independent distribution of said pressure via the teeth of the comb of member is completed by a sliding action of the head in a doctor blade carrier and the action of an inflatable sleeve.

4. The doctor blade of claim 3, wherein said elastically deformable member, the head and the base are electrically conductive or associated to be flush in such manner than an electric continuity be ensured between the lip and the doctor blade carrier via the elastically deformable member so as to discharge static electricity.

5. The doctor blade of claim 3, wherein the head has a profile allowing for installation on the doctor blade carrier with a plurality of inclination angles with respect to the longitudinal axis of the doctor blade.

6. The doctor blade of claim 1, wherein said elastically deformable member defines with the head and the base a quadrilateral being deformable according to the pressure by the doctor blade on a printing carrier.

7. The doctor blade of claim 6, wherein said deformable quadrilateral is selected from either a parallelogram which is deformable in such manner that an inclination angle of the lip on the printing carrier is constant irrespective of the pressure of the doctor blade on the printing carrier, or a trapezium whose major base is located nearer the head and whose minor base is located nearer the base, the inclination angle being positively modified under the pressure.

8. The doctor blade of claim 1, wherein said base in the form of a lip presents itself in the form of a ribbon of one or a plurality of layers.

9. The doctor blade of claim 1, wherein said elastically deformable member comprises, at least on one portion of the doctor blade length, a plurality of openings or bores above the lip, allowing for the passage of excess printing ink.

10. The doctor blade of claim 1, wherein said elastically deformable member is fixed to the head and/or to the lip either with immobilization or with a certain possibility to pivot relatively about an axis extending in parallel with the length of the doctor blade.

11. The doctor blade of claim 1, wherein two or more of the head, the base and the elastically deformable member are associated with each other in a releasable manner.

12. The doctor blade of claim 1, wherein at least one of the head and the base form an angle with respect to the longitudinal axis of the doctor blade with the elastically deformable member.

* * * * *